US007050011B2

(12) United States Patent
Ghabra et al.

(10) Patent No.: US 7,050,011 B2
(45) Date of Patent: May 23, 2006

(54) LOW PROFILE ANTENNA FOR REMOTE VEHICLE COMMUNICATION SYSTEM

(75) Inventors: Riad Ghabra, Dearborn Heights, MI (US); Argy Petros, Lake Worth, FL (US); Jason T. Summerford, Dearborn, MI (US); Qingfeng Tang, Novi, MI (US)

(73) Assignee: Lear Corporation, Southfield, MI (US)

( * ) Notice: Subject to any disclaimer, the term of this patent is extended or adjusted under 35 U.S.C. 154(b) by 148 days.

(21) Appl. No.: 10/749,487

(22) Filed: Dec. 31, 2003

(65) Prior Publication Data

US 2005/0146468 A1 Jul. 7, 2005

(51) Int. Cl.
*H01Q 1/32* (2006.01)
*H01Q 1/38* (2006.01)
*H01Q 9/38* (2006.01)

(52) U.S. Cl. ..... 343/711; 343/830; 343/905; 343/700 MS

(58) Field of Classification Search ..... 343/700 MS, 343/702, 705, 711–713, 825, 829, 830, 844–846, 343/848, 850, 904–905
See application file for complete search history.

(56) References Cited

U.S. PATENT DOCUMENTS

| | | | | | |
|---|---|---|---|---|---|
| 4,366,484 | A * | 12/1982 | Weiss et al. | ..... | 343/700 MS |
| 4,719,470 | A * | 1/1988 | Munson | ..... | 343/700 MS |
| 4,849,765 | A * | 7/1989 | Marko | ..... | 343/702 |
| 5,453,752 | A * | 9/1995 | Wang et al. | ..... | 343/700 MS |
| 5,508,710 | A | 4/1996 | Wang et al. | ..... | 343/725 |
| 5,589,842 | A * | 12/1996 | Wang et al. | ..... | 343/787 |
| 5,614,917 | A | 3/1997 | Kennedy et al. | ..... | 343/713 |
| 5,723,912 | A | 3/1998 | Ahrabian et al. | ..... | 307/10.5 |
| 6,246,368 | B1 * | 6/2001 | Deming et al. | ..... | 343/700 MS |
| 6,266,023 | B1 | 7/2001 | Nagy et al. | ..... | 343/846 |
| 6,292,154 | B1 * | 9/2001 | Deguchi et al. | ..... | 343/806 |
| 6,542,128 | B1 * | 4/2003 | Johnson et al. | ..... | 343/742 |
| 6,621,458 | B1 | 9/2003 | Petros et al. | ..... | 343/726 |
| 6,856,286 | B1 * | 2/2005 | Jo et al. | ..... | 343/700 MS |
| 6,903,687 | B1 * | 6/2005 | Fink et al. | ..... | 343/700 MS |
| 6,947,005 | B1 * | 9/2005 | Aisenbrey | ..... | 343/789 |
| 2003/0052826 | A1 | 3/2003 | Kralovec et al. | .... | 343/700 MS |
| 2003/0098812 | A1 | 5/2003 | Ying et al. | ..... | 343/702 |
| 2003/0156065 | A1 | 8/2003 | Jo et al. | ..... | 343/700 MS |
| 2003/0164799 | A1 | 9/2003 | Nantz et al. | ..... | 343/700 MS |
| 2003/0193438 | A1 * | 10/2003 | Yoon | ..... | 343/702 |

FOREIGN PATENT DOCUMENTS

| | | |
|---|---|---|
| EP | 0766340 | 2/1997 |
| EP | 1128466 | 8/2001 |
| EP | 1304765 | 4/2003 |
| JP | 11274843 | 10/1999 |
| WO | WO 00/03452 | 1/2000 |

* cited by examiner

*Primary Examiner*—Thuy Vinh Tran
(74) *Attorney, Agent, or Firm*—MacMillan, Sobanski & Todd, LLC

(57) ABSTRACT

A low profile antenna for use in a vehicle remote communication system in accordance with the present invention includes a printed circuit board having a copper ground plane mounted on a first side thereof. A dielectric spacer is mounted to the first side of the printed circuit board. A lineal antenna trace is disposed on the dielectric spacer. The antenna also includes a transmission line having first and second signal conductors. The first conductor is coupled to a feed point on the lineal antenna trace and the second conductor is coupled to both the ground plane and a second point on the lineal antenna trace spaced from the feed point.

18 Claims, 3 Drawing Sheets

LOW PROFILE ANTENNA FOR REMOTE VEHICLE COMMUNICATION SYSTEM

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates generally to communications systems for vehicles and, in particular, to a low profile antenna for a remote vehicle communication system.

An antenna is a metallic structure capable of receiving and/or emitting radio frequency (RF) energy, typically as part of a communication system. Remote communication systems are becoming more popular as part of options or standard features for vehicles including, but not limited to, remote keyless entry systems, remote engine start systems, and the like.

Typically, the antenna for the remote vehicle communication system is mounted in the engine compartment, close to the battery and the system it is intended to operate or communicate with. Many of these antennas, such as dipole antennas or the like, have a large profile and occupy a correspondingly large amount of space in the already cramped engine compartment or are otherwise incompatible with styling or manufacturing requirements. Those antennas that are not bulky often do not perform well enough to satisfy the ever-increasing activation range requirements for the communication systems.

It is desirable, therefore, to provide a low profile antenna for a vehicle communication system having increased gain and having a low profile so as to occupy as little physical space in the engine compartment as possible.

SUMMARY OF THE INVENTION

A low profile antenna for use in a vehicle remote communication system in accordance with the present invention includes a printed circuit board having a copper ground plane mounted on a first side thereof. A dielectric spacer is mounted to the first side of the printed circuit board. A lineal antenna trace is disposed on the dielectric spacer. The antenna also includes a transmission line having first and second signal conductors. The first conductor is coupled to a feed point on the lineal antenna trace and the second conductor is coupled to both the ground plane and a second point on the lineal antenna trace spaced from the feed point.

The low profile antenna in accordance with the present invention advantageously provides high gain antenna having increased reception and transmission range that occupies little physical space.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
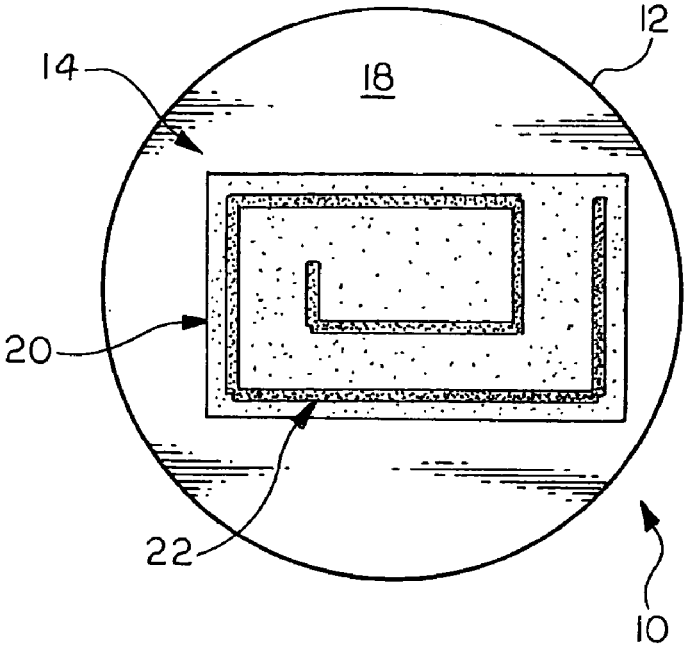
FIG. 1 is a schematic top plan view of a low profile antenna for a vehicle communication system in accordance with the present invention.
Figure 2:
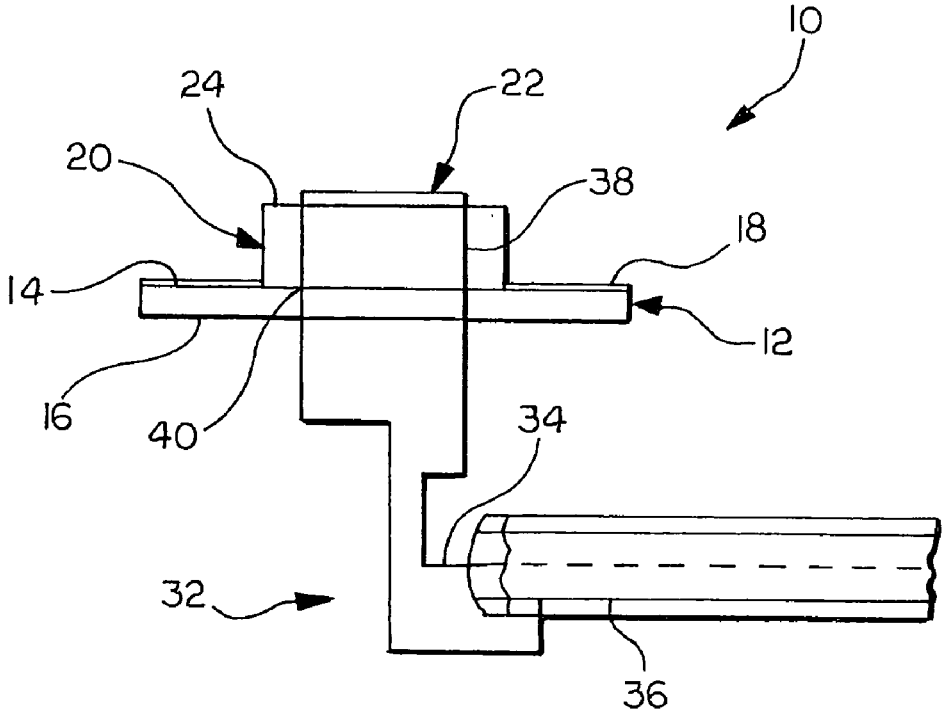
FIG. 2 is a schematic side elevation view of the low profile antenna of FIG. 1.
Figure 3:
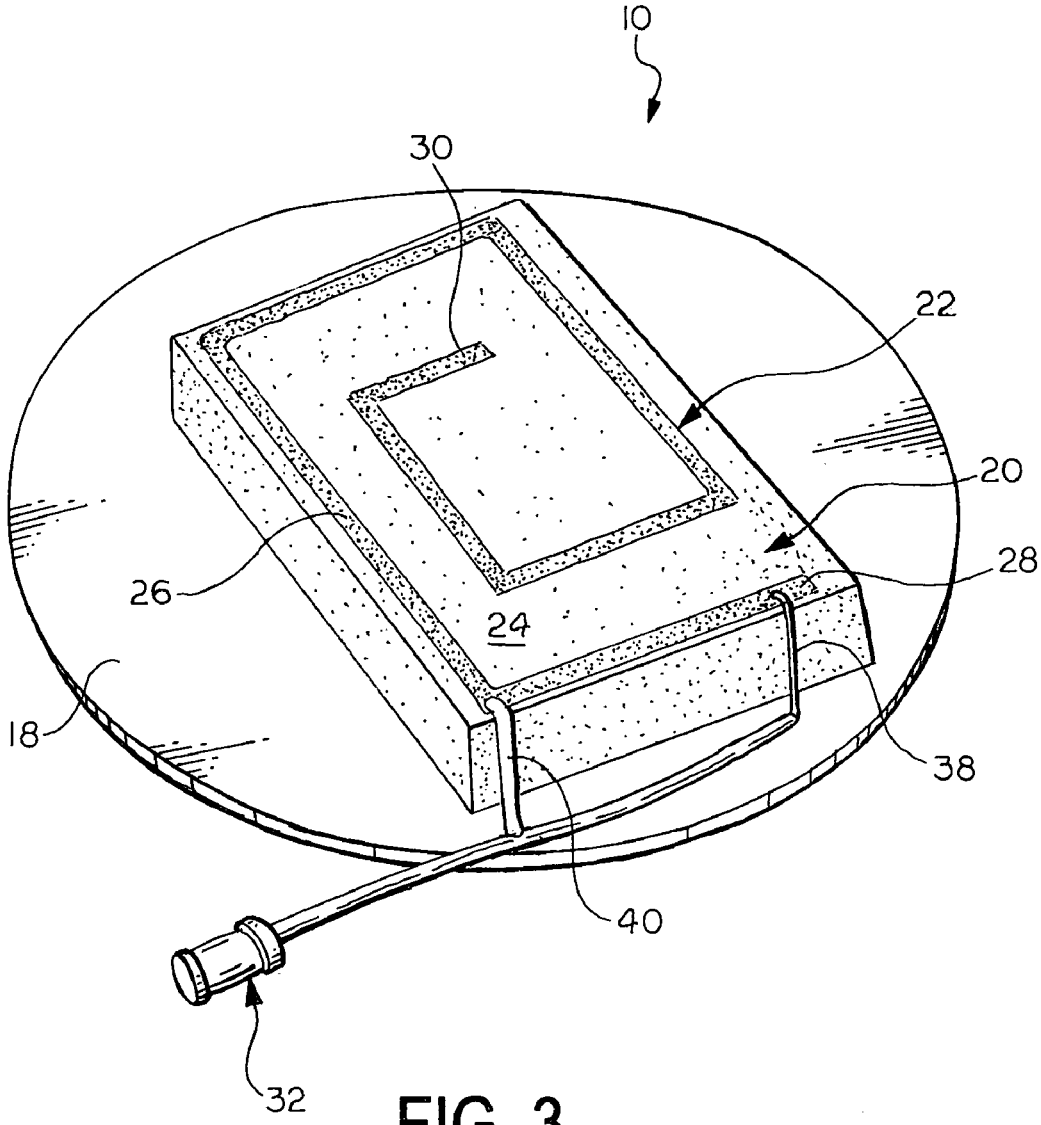
FIG. 3 is a top perspective view the low profile antenna shown in FIG. 1.

Referring now to FIGS. 1–3, a low profile antenna for use in a vehicle remote communication system (not shown) in accordance with the present invention is indicated generally at 10. The remote communication system may be, but is not limited to, an engine remote start communication system, a vehicle remote keyless entry communication system, and a tire pressure monitoring communication system.

The low profile antenna 10 includes a substantially circular printed circuit board 12 having a first side 14 and a second side 16. The circuit board 12 may be formed in any advantageous shape such as square, rectangular, or the like and, alternatively, may be replaced by any type of mounting substrate, such as a metallic plate or the like. A ground plane 18 is mounted on the first side 14 of the circuit board 12. The ground plane 18 is preferably constructed of copper or a similar material having good electrical conductivity properties.

A dielectric spacer 20 is mounted on the first side 14 of the circuit board 12 on top of the ground plane 18. The dielectric spacer 20 is generally rectangular-shaped and is preferably constructed of a plastic foam material or a similar material having similar dielectric properties. Preferably, the dielectric spacer 20 is a monolithic piece of plastic foam. Alternatively, the dielectric spacer 20 is formed in a hollow construction, with the air entrapped in the interior of the dielectric spacer 20 acting as an insulating dielectric along with the plastic foam material. Alternatively, the dielectric spacer 20 conforms to the substantially circular dimensions of the circuit board 12 and is substantially disk-shaped (not shown).

A lineal antenna trace 22 is disposed on an upper surface 24 of the dielectric spacer 20. The lineal antenna trace 22 is formed in a serpentine configuration on the surface 24 of the dielectric spacer 20. The lineal antenna trace 22 is preferably formed of copper or a similar material having good electrical conductivity properties. A copper foil tape may be used or a separate adhesive can be applied in order to maintain the trace 22 in place on the dielectric spacer 20. The lineal antenna trace 22 includes a middle region 26, a first end region 28, and a second end region 30, best seen in FIG. 3. The dielectric spacer 20 has a predetermined thickness to provide a distance between the lineal antenna trace 22 and the ground plane 18. The thickness of the dielectric spacer 20 may vary and is determined by the requirements of the antenna 10. The lineal antenna trace 22 has a predetermined thickness, which may vary and is also determined by the requirements of the antenna 10.

The low profile antenna 10 also includes a transmission line 32 having a first signal conductor 34 and a second signal conductor 36, best seen in FIG. 2. The first signal conductor 34 is preferably the central conductor or channel of a coaxial cable and the second signal conductor 36 is preferably the ground conductor or outer shield of the coaxial cable. The first conductor 34 is coupled to a feed point 38 on the lineal antenna trace 22 and the second conductor 36 is coupled to both the ground plane 18 and a second point 40 on the lineal antenna trace 22. The second point 40 is spaced apart from the feed point 38 by a predetermined distance, which distance is determined by a matching standing wave ratio (SWR) of the antenna 10 at a desired receiving frequency. The distance between the second point 40 and the feed point 38 is preferably much less than one quarter wavelength of a received RF signal. Preferably, the feed point 38 is located adjacent to the first end region 28 of the lineal antenna trace 22, and the second point 40 is located on the middle region 26 of the antenna trace 22. The transmission line 32 connects the antenna 10 with a receiver of the remote communication system.

The special construction of the antenna 10, in particular the respective distances between the feed point 38, the second end region 30, the second point 40 and the ground plane 18, as well as the shape and length of the lineal antenna trace 22, determines the unique performance of the antenna 10 having enhanced SWR and gain.

Figure 4:
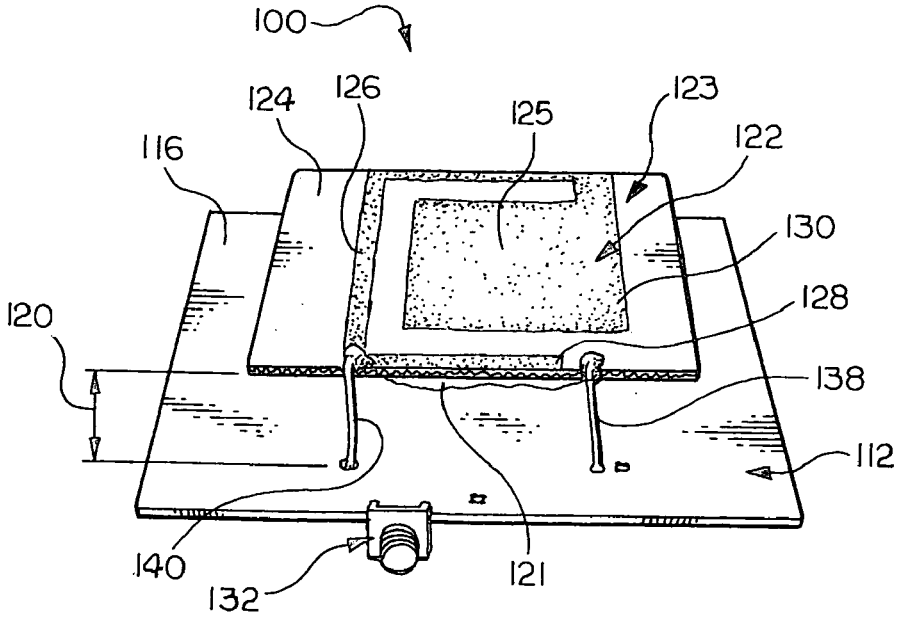
FIG. 4 is a top perspective view of an alternative embodiment of a low profile antenna in accordance with the present invention.
Figure 5:
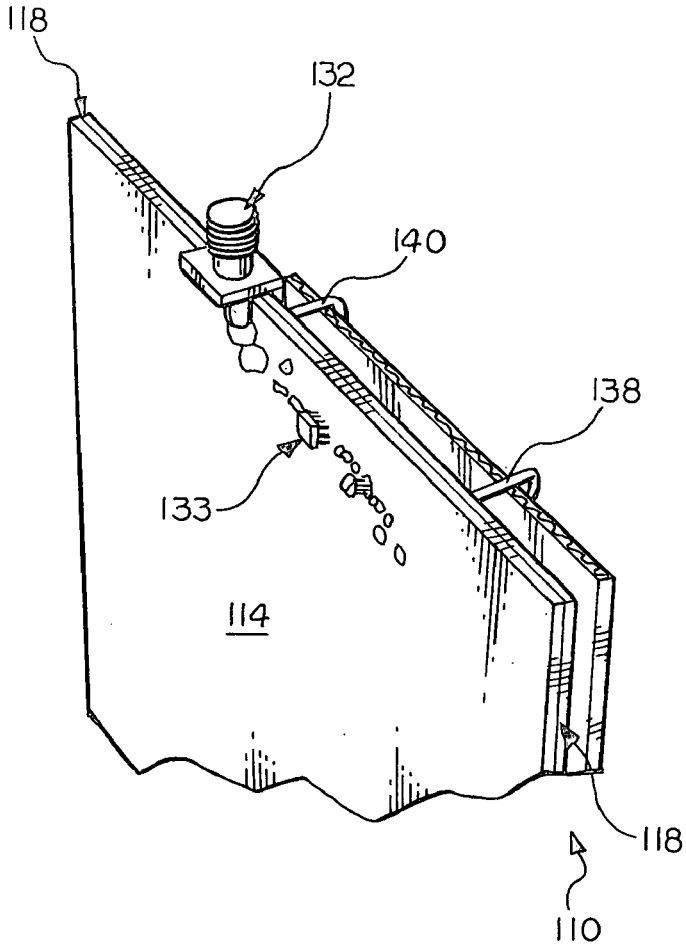
FIG. 5 is a bottom perspective view of the low profile antenna shown in FIG. 4.

Referring now to FIG. 4-5, an alternative embodiment of a low profile antenna is indicated generally at 100. The low profile antenna 100 includes a multi-layer printed circuit board 112 having a first layer 114, best seen in FIG. 5, and a second layer 116. A ground plane 118, best seen in FIG. 5, is mounted on a first side of the first layer 114 of the circuit board 112. The ground plane 118 is preferably constructed of copper or a similar material having good electrical conductivity properties. The second layer 116 is disposed on a side of the ground plane 118 opposite the first layer 114. Alternatively, the circuit board 112 is replaced by a mounting substrate, such as metallic plate or the like. If provided, the metallic plate acts as the ground plane for the antenna 10 or 100 and there is no separate ground plane, such as the ground planes 18 or 118.

A lineal antenna trace 122 is disposed on an upper surface 124 of an intermediate support member 123 that is spaced apart by a distance 120 from an upper surface the second layer 116 of the circuit board 112. The air in the distance 120 functions as a dielectric for the antenna 100, in a function similar to the dielectric spacer 20 for the antenna 10. The support member 123 may be a plastic sheet or similar device. The lineal antenna trace 122 also includes a planar or block portion 125 on the surface 124 of the support member 123. The lineal antenna trace 122 is preferably formed of copper or a similar material having good electrical conductivity properties. A copper foil tape may be used or a separate adhesive can be applied in order to maintain the trace 122 in place on the support member 123. The lineal antenna trace 122 includes a middle region 126, a first end region 128, and a second end region 130, best seen in FIG. 4. The distance 120 is a predetermined distance between the lineal antenna trace 122 and the ground plane 118. The distance 120 may vary and is determined by the requirements of the antenna 100. The lineal antenna trace 122 has a predetermined thickness, which may vary and is also determined by the requirements of the antenna 100.

The low profile antenna 100 also includes a transmission line 132 mounted on the printed circuit board 112 and having a first signal conductor (not shown) and a second signal conductor (not shown), such as the first signal conductor 34 and the second signal conductor 36 shown in FIG. 2. The first signal conductor is preferably the central conductor or channel of a coaxial cable and the second signal conductor is preferably the ground conductor or channel of the coaxial cable. A feed point 138 and a second point 140 each extends from the lineal antenna trace 122. The feed point 138 and the second point 140 are connected to a plurality of components, indicated generally at 133 and best seen in FIG. 5, mounted on a second side of the first layer 114. Preferably, the feed point 138 and the second point 140 provide support on one end of the support member 123 and a spacer 121 provides support on another end of the support member 123 to maintain the distance 120 between the trace 122 and the ground plane 118. The components 133 are preferably active components including, but not limited to, a low noise amplifier (not shown) or the like. The feed point 138 is connected to the first signal conductor of the transmission line 132 through at least one of the components 133 and the second point 140 is connected to the second signal conductor of the transmission line 132 and the ground plane 118 through at least another one of the components 133. The second point 140 is spaced apart from the feed point 138 by a predetermined distance, which distance is determined by a matching SWR of the antenna 100 at a desired receiving frequency. The distance between the second point 140 and the feed point 138 is preferably much less than one quarter wavelength of a received RF signal. Preferably, the feed point 138 is located adjacent to the first end region 128 of the lineal antenna trace 122, and the second point 140 is located on the middle region 126 of the antenna trace 122. The transmission line 132 connects the antenna 100 with the remote communication system.

By locating the components 133 on the second side of the first layer 114, the components 133 are separated from the lineal antenna trace 122 by the ground plane 118, which provides good RF isolation between the components 133 and the antenna trace 122. In addition, the planar or block portion 125 results in a better SWR and thus increases the gain of the antenna 100 by one or two dB.

The second layer 116 of the printed circuit board 112 protects the ground plane 118, but has insufficient thickness to avoid the need for the distance 120.

The antenna 10 and 100 in accordance with the present invention is a high gain antenna for remote communication systems such as remote start applications requiring long activation range. The antenna 10 or 100 in accordance with the present invention advantageously achieves a performance close to that of a large antenna, such as a dipole antenna, without occupying as much space as a typical dipole antenna, making the antenna 10 or 100 suitable for a variety of vehicle remote communication systems.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A low profile antenna for use in a vehicle remote communication system utilizing a predetermined RF signal, comprising:

a printed circuit board having a ground plane mounted on a first side thereof;

a dielectric spacer mounted to said first side of said printed circuit board;

a lineal antenna trace disposed on said dielectric spacer; and a transmission line having first and second signal conductors, said first conductor being coupled to a feed point on said lineal antenna trace and said second conductor being coupled to both said ground plane and a second point on said lineal antenna trace spaced from said feed point;

wherein said antenna is an active antenna further comprising a plurality of active components mounted on a second side of said printed circuit board, and wherein said first conductor is coupled to at least one of said active components.

2. The antenna according to claim 1 wherein said dielectric spacer is mounted to said ground plane.

3. The antenna according to claim 1 wherein said lineal antenna trace includes a middle region and first and second end regions.

4. The antenna according to claim 3 wherein said feed point is located at one of said first and second end regions and said second point is located at said middle region.

5. The antenna according to claim 1 wherein at least one of said active components is a low noise amplifier.

6. The antenna according to claim 1 wherein said dielectric spacer is plastic foam.

7. The antenna according to claim 1 wherein said lineal antenna trace is spaced apart by a predetermined distance from said ground plane less than one quarter wavelength of said RF signal.

8. The antenna according to claim 1 wherein said feed point and said second point of said lineal antenna trace are spaced apart by a predetermined distance.

9. The antenna according to claim 1 wherein said lineal antenna trace is formed in a serpentine configuration.

10. The antenna according to claim 1 wherein said lineal antenna trace includes a substantially planar portion.

11. The antenna according to claim I wherein said printed circuit board is a multi-layer printed circuit board and wherein said ground plane is mounted on a first layer of said circuit board, and a second layer of said circuit board is disposed between said ground plane and said dielectric spacer.

12. A low profile antenna for use in a vehicle remote communication system utilizing a predetermined RF signal, comprising:

a printed circuit board having a ground plane mounted on a first side thereof;

an intermediate support member mounted to said first side of said printed circuit board;

a lineal antenna trace mounted to said support member and spaced apart from said ground plane by a predetermined distance; and a transmission line having first and second signal conductors, said first conductor being coupled to a feed point on said lineal antenna trace and said second conductor being coupled to both said ground plane and a second point on said lineal antenna trace spaced from said feed point;

wherein said feed point and said second point of said lineal antenna trace are spaced apart by a predetermined distance less than one quarter wavelength of said RF signal.

13. The antenna according to claim 12 wherein said lineal antenna trace is formed in a serpentine configuration.

14. The antenna according to claim 13 wherein said lineal antenna trace includes a substantially planar portion.

15. The antenna according to claim 13 wherein said printed circuit board is a multi-layer printed circuit board and wherein said ground plane is mounted on a first layer of said circuit board, and a second layer of said circuit board is disposed between said ground plane and said dielectric spacer.

16. The antenna according to claim 13 wherein said lineal antenna trace includes a middle region and first and second end regions.

17. The antenna according to claim 16 wherein said feed point is located at one of said first and second end regions and said second point is located at said middle region.

18. A low profile antenna for use in a vehicle remote communication system utilizing a predetermined RF signal, comprising:

a mounting substrate providing a ground plane;

an intermediate support member mounted to said mounting substrate;

a lineal antenna trace mounted to said support member and spaced apart from said ground plane by a predetermined distance, said lineal antenna trace including a middle region and first and second end regions; and a transmission line having first and second signal conductors, said first conductor being coupled to a feed point on said lineal antenna trace and said second conductor being coupled to both said ground plane and a second point on said lineal antenna trace spaced from said feed point, wherein said feed point is located at one of said first and second end regions and said second point is located at said middle region, and wherein said feed point and said second point are spaced apart by a predetermined distance less than one quarter wavelength of said RF signal.

* * * * *